United States Patent [19]

Arledge, II

[11] 4,096,877

[45] Jun. 27, 1978

[54] FREEZEPROOF SANITARY WATER SUPPLY APPLIANCE

[76] Inventor: E. R. Arledge, II, 5600 "C" St., Little Rock, Ark. 72205

[21] Appl. No.: 687,327

[22] Filed: May 17, 1976

[51] Int. Cl.[2] ..... E03B 9/04

[52] U.S. Cl. ..... 137/281; 137/282; 137/292; 137/301; 137/467

[58] Field of Search ..... 137/272, 281, 282, 291–295, 137/299–302, 304–307

[56] References Cited

U.S. PATENT DOCUMENTS

| | | | |
|---|---|---|---|
| 100,389 | 3/1870 | Fort | 137/281 |
| 137,476 | 4/1873 | Paul | 137/281 |
| 860,424 | 7/1907 | Traxel | 137/281 |
| 2,630,130 | 3/1953 | Murdock et al. | 137/281 |
| 3,770,003 | 11/1973 | Uroshevich | 137/281 |
| 3,926,207 | 12/1975 | Anderson | 137/281 |

FOREIGN PATENT DOCUMENTS

| | | | |
|---|---|---|---|
| 25,159 | 12/1883 | Germany | 137/281 |

*Primary Examiner*—Irwin C. Cohen
*Assistant Examiner*—Richard Gerard
*Attorney, Agent, or Firm*—Hill, Gross, Simpson, Van Santen, Steadman, Chiara & Simpson

[57] ABSTRACT

A water supply control appliance adapted to be buried in soil beneath local frost level contains a chamber fitted with a piston which is spring-biased in opposition to inlet water pressure. Such pressure forces the piston to fully charged position at one end of the chamber whereupon a piston valve is opened to pass the water to outlet. Closing the supply valve releases pressure on the piston, permitting the piston to move in response to the spring bias. The piston movement pumps water below the piston out to drain and drains water from the outlet lines into the expanded chamber above the piston, safe from frost. Water in the drain line will, at the end of the piston travel, fall back into the chamber above the piston after piston travel is completed, when a piston ring seal spans a port to the drain line.

18 Claims, 5 Drawing Figures

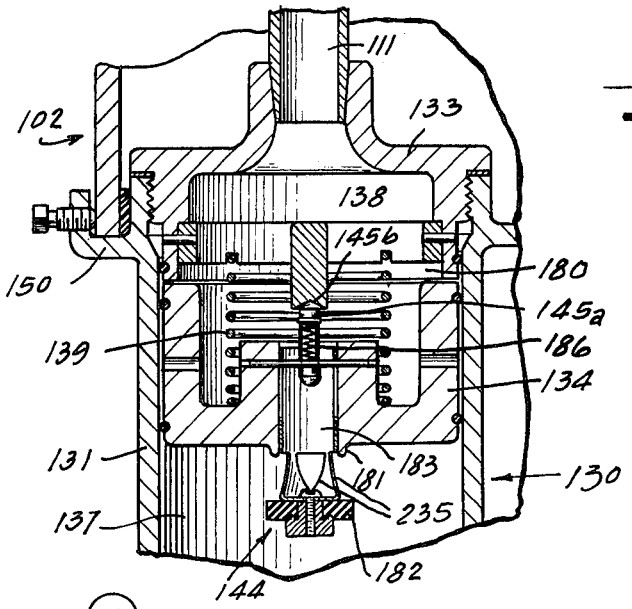
Fig. 3
Fig. 1
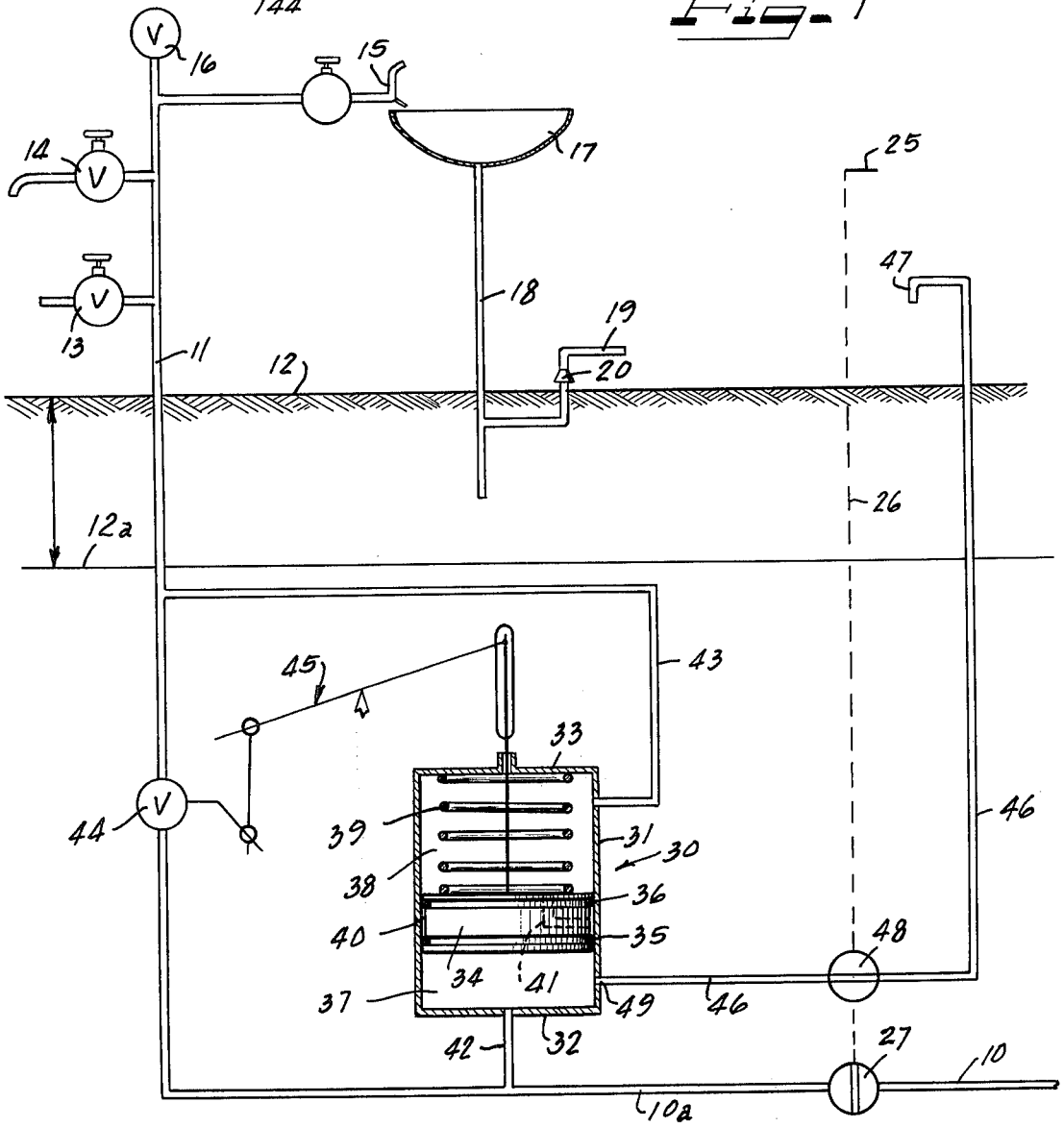

217
208
198
199
199
216
212
116
207
101
213
211
214
125
113
224
203
200
206
210
223
147
215
202
201
12
197
196
221
222
195
220
205
111
226
102
225
13
230
231
232

190
175
227
133
188
165
164
153
126
151
152
150
180
1456
110
154
163
150
189
171
172
170
162
139
146
174
156
148
130
138
155
173
168
131
157
100
166
167
145a
141
160
136
186
161
183
185
134
184
169
140
159
135
181
182
146
127
149
144
137
142
158
132
187
142a 468
311
333
462
450
338
461
465
452
467
463
472
470
489
455
460
466
188
154
476
150
189
454
471
475
456
451
473
473a
474
451
453
130
480
131
464
485
145a
486
136
334
146
135
144
137
142

311
468
333
462
450
467
465
338
490
472
460
452
455
461
188
154
470
471
476
150
451
473
454
473a
474
486
464
475
480
456
145a
334
131
144
137
130

FREEZEPROOF SANITARY WATER SUPPLY APPLIANCE

BACKGROUND OF THE INVENTION

1. Field of the Invention

The present invention relates to plumbing devices adapted to prevent freezing of exposed water lines while maintaining the sanitary condition of the water supply system.

2. The Prior Art

Where parts of a potable water supply system are extended outside a building structure to surrounding ground areas, the problem is presented to protect the exposed water-line systems from freezing with water contained therewithin while simultaneously protecting the water system from contamination from ground and surface water. Such contaminated water must be kept out of the pipes even between the cut-off valve and the water outlet not only to keep that pipe clean but to avoid contamination of the entire water supply system by backflow of such water in the event of a reduced pressure in the system at the time of opening a remote valve controlling flow through the contaminated pipe.

A typical basic lawn hydrant system has an outlet connection and valve box installed flush with the grade level. When a valve located below local frost level in the soil is turned off, it closes off the supply pipe and opens a drain port so that backflow of standpipe riser water may occur through the valve and drain out below grade to prevent freezing of the standpipe. No protection is offered in such device to prevent entry of contaminated ground water through the opening and into the standpipe riser. Installing a check valve in the drain opening is insufficient because possible trash or particle accumulation at the check valve seat will prevent reliable operation. The flush mounted valve box becomes another source of possible contamination by surface waters.

The simple drain port device is more acceptable if the drain opening is to air at a remote, lower elevation and a backflow preventer is installed in the flush box. Such installations are, of course, not suited to use in flat areas, and the backflow preventer must be separately manipulated to allow breaking a vacuum in the standpipe riser to allow draining of water from the standpipe riser. Addition of reduced pressure backflow preventers to prevent contamination of the supply main further complicates such systems and adds substantially to installation costs.

A frost-proof hydrant having no separate drain and using an ejector action from a reservoir is known to the art. In such device, a venturi nozzle is fitted into the water supply line and a reservoir below local frost level in the appliance is connected to the venturi chamber by a tube. Flow of water to the venturi chamber creates a suction which draws water from the reservoir into the main flow. When the water supply is turned off, water in the standpipe riser flows by gravity into the reservoir. This design reasonably well preserves the sanitary condition of the water line but creates a large pressure drop at the venturi. It also is not suitable for applications such as drinking bubblers where short durations of water usage do not fully discharge the reservoir.

SUMMARY OF THE INVENTION

An objective of the present invention is to provide a unitary appliance having all features built-in to provide a sanitary potable water supply adapted for any terrain features and not requiring any separately installed protective devices, thereby minimizing risks of improper installation of components.

In accordance with the invention, a freeze-proof sanitary valve assembly is provided comprising a housing forming a liquid reservoir and adapted to be buried in soil below a local frost level. A piston is slidable in the housing through the reservoir and normally sealingly divides the reservoir into variable first and second chambers. The piston is biased to a position minimizing the volume of the first chamber, but such bias is overcome by the force of pressurized water in the first chamber communicated thereto from a water supply line. The second chamber of the reservoir communicates to an exposed water outlet device through which water passes to atmosphere.

A valve selectively communicates the supply line to the outlet device when the piston has moved to a fully charged position minimizing the volume of the second chamber. A pump-out passage selectively communicates the first chamber to atmosphere when the flow of pressurized water to the first chamber has been turned off. Thus, inflow of water from the supply line to the first chamber moves the piston through the reservoir to a fully charged position, whereupon the valve opens to permit flow of water to the outlet device.

Upon termination of the flow from the supply line and opening of the pump-out passage, the piston is movable away from its fully charged position, closing the valve. The bias upon the piston then will pump water from the first chamber out the pump-out passage to drain, simultaneously drawing water from the lines of the outlet device into the second chamber, where it is protected from freezing temperatures.

Breaking of a seal about the piston as the piston reaches its lowermost position permits water in the pump-out passage to fall back through the passage and into the second chamber, thereby also protecting the drain line from freezing.

BRIEF DESCRIPTION OF THE DRAWINGS

FIG. 1 is a schematic view of the general layout of a water supply appliance installed in accordance with the principles of the present invention.

FIG. 3 is a detailed view of the upper part of the chamber of FIG. 2 when water is flowing through the system.

DESCRIPTION OF THE PREFERRED EMBODIMENTS

Figure 2:
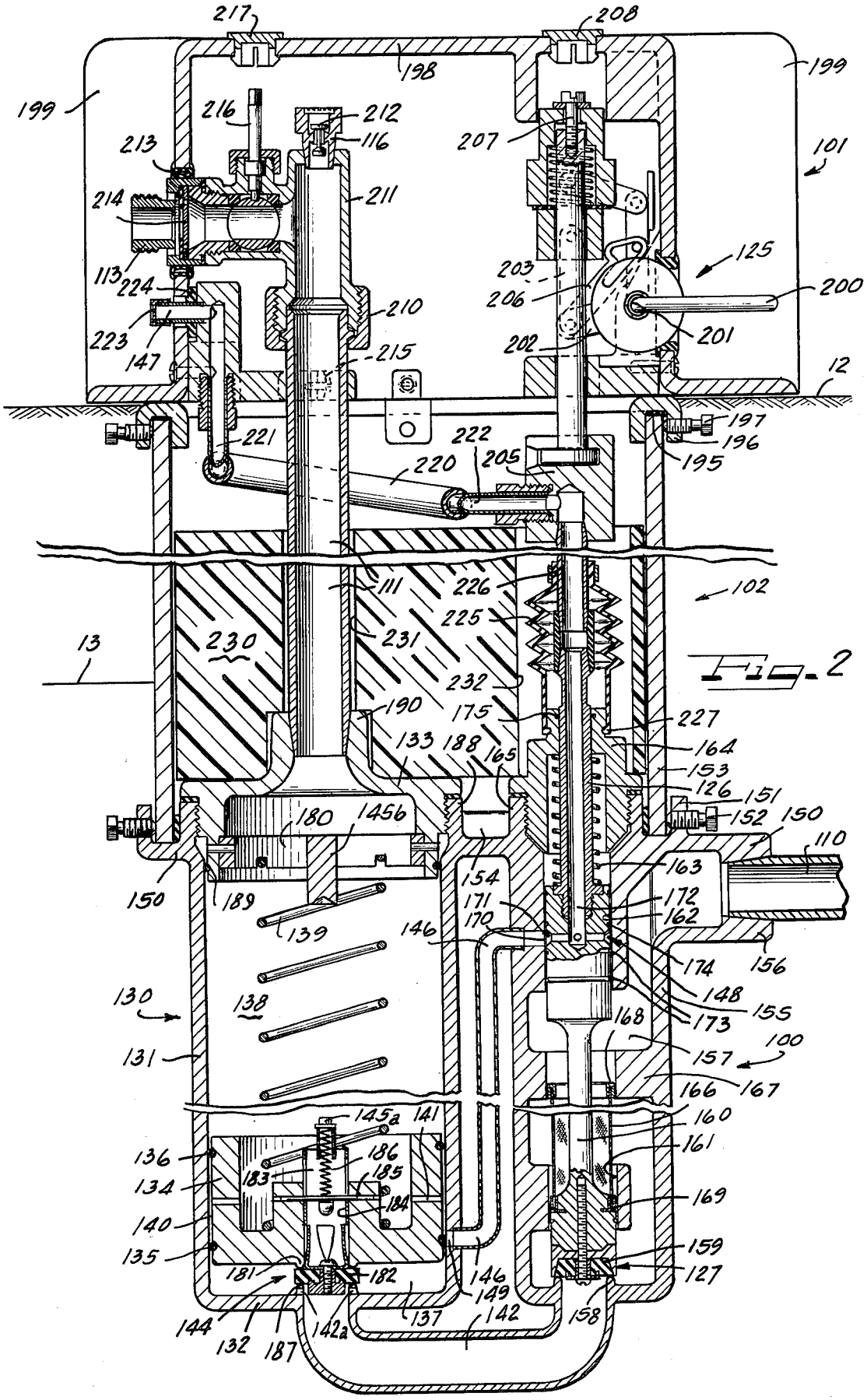
FIG. 2 is a side, sectional view through an apparatus of the present invention.

As shown schematically in FIG. 1, a pressurized water inlet line 10 is connected to supply water under pressure to a standpipe 11. The inlet pipe 10 is buried below a ground level 12 by a distance at least equal to the depth of a frost line 12*a;* that is, the maximum depth to which the soil may be expected to freeze during winter conditions at the particular locality of installation of the appliance. The standpipe 11 may have any of several outlets therefrom, including a hose bibb 13, a jug filler 14, and/or a drinking fountain bubbler 15, each controlled by its own separate valve.

A vacuum breaker valve 16 located on the standpipe 11 contains a ball check or other device known in the art to prevent outflow of pressurized water but to open the pipe 11 to atmosphere upon loss of pressure therein. Any of the standpipe outlets 13–15 may pass water into a collection bowl 17 having a drain line 18 which passes to a rock-filled French drain or a sewer connection with trap and vent. A pump-out connection 19 having an air gap 20 may be provided on the drain line 18.

To control the flow of water from the pressurized inlet line 10, a main valve handle 25 is provided having a connection 26 to a main flow valve 27 in the inlet line 10. This main flow valve 27 is operable independently of any of the standpipe outlets 13–15.

In accordance with the principles of the present invention, a reliable, sanitary freeze protection appliance is added to the plumbing system of FIG. 1 as shown schematically therein. A pump-out assembly 30 comprises a reservoir wall 31 of elongate, annular form and a first lower end 32 and a second upper end 33. A piston 34 is received within the wall 31 and adapted for axial movement therein.

The piston 34 is fitted at its annular periphery with a first annular seal 35 and a second annular seal 36. The seals 35, 36 engage inner surfaces of the wall 31 and divide the interior reservoir of the assembly 30 into variable first and second chambers 37 and 38, respectively. A bias means such as a coil spring 39 is fitted within the second volume 38 of the chamber 30 to bias the piston 34 toward the first end 32 of the assembly 30, to minimize volume of such first chamber 37. An annular recess 40 is formed about the periphery of the piston 34 between the two annular seals 35, 36. A restricted-flow passage 41 extends through the piston 34 communicating the second chamber 38 to the annular space 40.

The first chamber 37 of the pump-out assembly 30 communicates with an inlet line **10*a* downstream of the valve 27 through a connection 42. The second chamber 38 of the assembly 30 communicates to the standpipe 11 through a line connection 43. A piston valve 44 is connected between the inlet line 10*a* and the standpipe 11 and is controlled by a valve actuator assembly 45**.

The actuator assembly 45 opens the flow from the inlet line 10 or **10*a* to the standpipe 11 only when the piston 34 has reached the top of its travel in the pump-out assembly 30. The valve actuator 45 is arranged, in one form of the invention, to create a pressure drop across the piston valve 44 such that the force of the inlet fluid pressure within the first chamber 37 is equal but opposite to the forces of the output fluid pressure within the second chamber 38 and the spring 39. Alternatively, the valve actuator 45 may lock the piston 34 in a charged position, and, simultaneously with such locking, open the piston valve 44** so that only a small pressure drop occurs thereacross.

In either embodiment once the valve 44 is opened fluid flows from the inlet lines 10 and **10*a* through the valve 44 to the standpipe 11 and out any of the utilization points 13–15 provided. When the main flow valve 27 is closed, flow through the inlet line 10 is stopped. Pressure within the chambers 37 and 38 will equalize by flow through the piston valve 44. Where the piston 34 is free to move, in either the pressure-hold embodiment or the locked-piston embodiment after release of the lock, the piston will move downwardly in the orientation of FIG. 1 under the bias of the spring 39. The piston valve 44 will then be closed by the valve actuator linkage 45**.

Water within the first chamber 37 is then discharged by the moving piston 34 through a pump-out line 46 to a drain 47 to atmosphere. An air gap between the drain 47 and ground level helps to insure against contamination by backflow through the line 46 in case of flood. Flow through the pump-out line 46 to drain 47 is controlled by a pump-out valve 48 which is actuated in conjunction with the main valve control 25, to be open when the main flow valve 27 is closed and to close when the main flow valve 27 is open.

Thus, in the schematic view of FIG. 1, water within the first chamber 37 will be forced by the spring 39 and piston 34 through the pump-out passage 46 to drain 47. The second chamber 38 will expand as the piston 34 moves downwardly, and water from the standpipe 11 will be drawn into the second chamber 38 as it increases in volume. The vacuum breaker 16 will open as soon as pressure within the standpipe 11 reduces to atmospheric pressure permitting the water to flow by gravity into the enlarging second chamber 38.

As the piston 34 reaches the bottom of its travel, the first sealing means 35 thereabout will be spanned by the pump-out port 49 in the reservoir wall 31, opening the second volume 38 to the pump-out passage 46 through the restricted flow passage 41 through the piston 34 and the annular space 40 thereabout. Since the second chamber 38 has been sized to exceed the volumetric capacity of the standpipe 11, it will accept all of the water within the standpipe 11 and associated plumbing fixtures 13–15 and have some available volume left therewithin. Water within the pump-out passage 46 up to the drain 47 which lies above the water level within the second chamber 38 will reverse its flow and fall back to collect within the pump-out assembly 30. Thus both the standpipe 11 and its associated fixtures 13–15 and the discharge passage 46 to drain 47 above the frost line will be free from water and thus cannot freeze under adverse surface weather conditions.

In the form of the invention disclosed in FIG. 2, all the parts of the system from the inlet line 10 and the hose bibb 12 to the drain 47 are shown in a unitary assembly and corresponding numerical designations are used to designate corresponding parts.

FIRST EMBODIMENT

A first embodiment of the sanitary, freeze-proof water supply appliance of the present invention is shown in FIG. 2 as comprising three chief components. A lower valve unit 100 contains parts corresponding to the main flow valve 27, the pump-out valve 48, the pump-out piston assembly 30, and the piston valve 44 and related valve actuator assembly 45 as shown schematically in FIG. 1. A lawn hydrant unit 101 is located above ground level 12 and, in the embodiment shown, contains apparatus corresponding to the main valve control handle 25, the pump-out drain 47, the standpipe 11, a hose bibb 13, and the vacuum breaker 16. An annular burial casing 102 sealingly joins a lower portion of the lawn hydrant 101 with an upper flange of the valve portion 100 to permit access to the mechanism of the valve portion 100 from ground level without excavation of earth about the assembly.

As shown in FIG. 2, the valve portion 100 comprises two cylinders joined at their upper portion by a solid flange 150 with an annular configuration, which may be round or oval. The flange 150 has an annularly-extending portion 151 carrying clamping bolts 152 adapted to engage a lower portion of a wall 153 of burial casing 102. The burial casing wall 153 is received between the annular flange 151 of the flange 150 and a sealing member 154 snug for snut fit with an interior surface of the burial casing wall 153.

Extending from and below the flange 150 on one side thereof is a main valve housing assembly 155 which is generally hollow and cylindrical. A pressurized water-supply pipe 110 leads into the main valve housing 155 at a fitting 156. The main valve housing 155 has a waterway passage 157 contained therewithin extending from the inlet pipe 110 and the flange 156 to a main flow valve 127 located in a bottom portion thereof.

The main flow valve 127 has an annular valve seat 158 formed in a lower portion of the main valve housing 155 and a valve head 159 which is relatively reciprocable with respect to the seat 158. The valve head 159 is carried on a valve spool 160, which in turn is connected threadedly to a valve actuator tube 126 which extends from the main valve housing and is controlled by a main valve actuator 125 arranged on the lawn hydrant 101. The lower portion of the valve spool 160 is guided for reciprocal movement by a cylindrical surface 161 arranged in the main valve housing 155. An upper portion of the spool 160 is guided by a cylindrical sealing wall 162 which is a part of a pump-out valve 148. A main valve spring 163 applies a downward bias to the valve spool 160 at its upper end, the spring 163 being footed upon a main valve housing head 164 about the valve actuator tube 126 which is threadedly engaged with an upstanding portion 165 of the oval flange 150.

A main valve strainer 166 is provided within the main valve housing 155 between a flow channelling flange 167 and a mounting portion for the valve head 159 on the valve spool 160. An upper end of the strainer 166 is fitted with a seal 168 which rides within the opening in the flange 167 and prevents flow from bypassing the strainer. The lower portion of the strainer 166 is sealed to the valve spool 160 by a seal 169.

The upper portion of the valve spool 160 forms the pump-out valve 148. As noted above, the valve spool 160 rides within the cylindrical wall 162 in the valve housing 155, the two components having cooperating lands and recesses to develop a valving function when the spool is moved relative to the valve body. An opening 170 is formed in the main valve housing 155 to receive flow from a pump-out passage 146. When the valve head 159 of the main valve 127 is fully seated upon the valve seat 158, an annular port 171 in valve spool 160 registers with the opening 170.

The annular port 171 communicates radially inwardly of the valve spool 160 of an axial flow passage 172 provided within the valve spool 160 and the main valve actuator tube 126. This passage 172 communicates through the burial casing 102 to a drain 147 in the lawn hydrant 101.

The pump-out passages 170, 171 and 172 are sealed from the pressurized water of the inlet 110 by O-rings 173 provided upon the upper part of the valve spool 160 to bear against the cylindrical wall 162 of the main valve housing 155. A further seal 174 is provided above the annular port 171 upon the valve spool 160 to seal the assembly against leakage of water into or from the sanitary lines 146 and 172 from the interior of the burial casing 102. A further seal and bearing 175 is provided at the top of the main valve housing head 164, engaging the outside of the main valve actuator tube 126.

Arranged immediately adjacent the main valve housing 155, affixed to and extending below the flange 150 of the valve portion 100, is a pump-out assembly 130 contained within a pump-out assembly wall 131 having a lower first end wall 132 and a second upper end wall 133. Similarly to the arrangement described in connection with the schematic diagram of FIG. 1, a piston 134 is slidably received within the wall 131 upon bearing and seal rings 135, 136. The piston 134 and its seals 135, 136 divide the volume within the pump-out assembly 130 into first and second chambers 137 and 138, which vary in size depending upon the position of the piston 134. A coil compression spring 139 extends between a transverse bar 180 in an upper portion of the assembly 130 and an upper surface of the piston 134. An annular recess 140 is provided about the piston 134 between the seals 135 and 136, and a restricted flow passage 141 is provided through the axially extending walls of piston 134 from the space 140 into the second chamber 138.

A piston valve 144 is provided in the axial center of the piston 134. The piston valve 144 comprises an annular valve seat 181 formed on a lower surface of the piston 134 and a valve head 182 provided therebelow. The valve head 182 is axially reciprocated with respect to the valve seat 181 upon engagement of a valve actuator plunger **145*a* with a stop portion 145*b* affixed to a transverse bar 180 in the upper portion of the assembly 130**.

The actuator plunger **145*a* comprises a generally cylindrical tube 183 which carries the valve head 182 on a lower portion thereof and extends through the piston 134 in an axial bore 184 therethrough, being retained in said bore by a transverse bar 185 engaged in a slot in the tube 183. A coil compression spring 186 engaged between the bar 185 and a head portion of the valve actuator loads the piston valve head 182 into the valve seat 181**.

Water is provided to the first chamber 137 of the pump-out assembly 130, when the main valve 127 is open, through a line 142 and through openings **142*a* formed in an annular bumper or stop 187 upon the first end wall 132 of the pump-out assembly 130. The flow passages 142*a* are sufficiently non-restrictive so that no appreciable pressure drop occurs upon flow of water through these passages. However, a pressure drop does occur in the flow of fluid through the passage 141 formed in the piston 134. The pressure drop relationship between the passage 142*a* and 141 results in the chamber 137 being pressurized initially to cause the piston 134 to rise against the spring 139, even though the first chamber 137 does communicate with the second chamber 138 when the piston 134 is in its lowermost position, by the spanning of the first or lower seal 135 by a pump-out port 149 in the wall 131, and through the space 140 and the passage 141, as described in conjunction with FIG. 1**.

As shown in the drawing FIG. 2, a pump-out passage 146 extends from the pump-out port 149 in the pump-out assembly wall 131 near the lower or first end 132 thereof to the port 170 in the pump-out valve 148.

As shown in the drawing, a head or second end 133 of the pump-out assembly 130 is threadedly engaged with an upstanding flange 188 extending from the flange 150. An O-ring seal 189 is provided between a downwardly-extending portion of the head 133 in the interior of the assembly wall 131 to maintain the sanitary integrity of the water system. The head 133 of the assembly 130 further has an upstanding flange portion 190 in which the standpipe 111 is connected in fluid-tight engagement.

The lawn hydrant 101 rests atop the burial casing 102 in sealed engagement therewith by means of a gasket 195 received atop the casing wall 153. The hydrant 101 has a downwardly-extending, U-shaped flange 196 engaging the case wall 153 and having clamping bolts 197 received therethrough.

The lawn hydrant 101 comprises an outer shell 198 with protective wings 199 on either side thereof. On a right side of the hydrant 101 in FIG. 2 is provided the main valve control 125, and on the left side the water outlet devices including the hose bibb 113. The main valve control 125 principally comprises a foot pedal 200 which is rotatable about a pivot point 201 within the housing 198. Actuating linkages 202, 203, and 204 control the vertical positioning of the main valve actuator tube 126 from the foot pedal 200 and through a coupling member 205 removably engaged with the link member 204 within the burial casing 102. A lock linkage 206 is conveniently provided in the control 125 so that full depression of the foot pedal 200 will lock the assembly in an "on" position until a further tap of the pedal 200 releases the link 206 for system shut-off. An adjusting screw 207 accessible through a removable cap 208 in the hydrant housing 198 permits adjustment of the linkage system so that the foot pedal 200 may be maintained in a horizontal "off" position for operation despite wear of the parts. Generally, the linkage system of the control 125 is conventional and is therefore not shown in detail herein.

The left side of the lawn hydrant 101 is arranged about the standpipe 111 which rises into the housing 198 and is affixed to the hose outlet bibb 113 by a connector 210 and an adaptor fitting 211. The fitting 211 has a vacuum breaker or vacuum relief device 116 fitted thereon whereby the presence of pressure within the standpipe 111 will raise a seal member 212 to seal the fitting 211 from leakage of water therethrough, but upon release of pressure in the pipe 111 will admit air to the fitting 211 and the standpipe 111 for the backflow of water from the fitting 211 and the standpipe 111.

The hose bibb 113 is connected to the fitting 211 to extend outside the housing 198 through a vermin guard 213 and a simple backflow preventer device 214. A clamp 215 provided on the housing 198 and engaging the standpipe 111 maintains the hose bibb 113 in fixed relation to the housing 198. An auxiliary flow control valve 216 is provided in the fitting 211 downstream of the vacuum breaker 116, the valve being accessible for control through a removable cap 217 thereabove in the housing 198.

In the housing 198 beneath the hose bibb 113 and fitting 211, as shown in FIG. 2, is the pump-out drain fitting 147. The drain 147 communicates with the flow passage 172 in the control tube 126 through the fitting 205 and a flexible coupling 220. The coupling 220 compensates for variations in distance between a lower portion 221 of the drain fitting 147 and an outlet fitting 222 on the coupler 205 as the latter moves upwardly and downwardly with respect to the drain fitting end 221. An opening 223 of the drain passage 147 is provided with a mesh or other screening device to maintain the sanitary integrity of the drain line 147. The housing 198 is protected against entry of vermin about the discharge port by an annular seal member 224.

The burial casing 102 encloses the standpipe 111 and the main valve actuator tube 126 together with the discharge line coupling and pump-out passage members 205 and 220–222. Since the main valve actuator 126 moves with respect to the main valve housing head 164, a flexible boot 225 is clamped at one of its ends 226 to the exterior of the actuator tube 126 and at its other end 227 to the exterior of the main valve housing head 164. The interior of the burial casing 102 is filled with an insulating foam filler 230, which is molded to shape with axial bores 231 and 232 formed therein to clear the standpipe 111 and the parts associated with the main valve actuator 126, respectively. The foam filler 230 insulates the pump-out assembly 130 and the main valve housing 155 to prevent penetration of freezing temperatures substantially below the normal local frost line 12*a*.

In operation, the structure of FIG. 2 functions as follows. Pressurized water is available through the inlet line 110. Depression of the foot valve 200 will cause the link 204 in the lawn hydrant 101 to rise, raising the coupling member 205 and the main valve actuator tube 126 together with the valve spool 160 within the main valve housing 155 of the valve portion 100. The valve head 159 will be unseated from the valve seat 158, permitting water to flow from the inlet line 110 through the main valve strainer 166 and into the connecting passage 142. From the passage 142 the water will flow into the first volume 137 through the passages 142*a* formed through the abutment ridge 187 on the first end 132 of the pump-out assembly wall 131. The influx of pressurized water into the first chamber 137 will cause the piston 134 to rise within the assembly wall 131 against the force of the spring 139 therein. Insufficient water will flow about the first seal 135, through the port 149 and annular chamber 140, and through the passage 141 in the piston 134 to equalize pressures above and below the piston while the first seal 135 is spanning the discharge port 149. Once the lower seal 135 has risen above the level of the port 149, the first and second volumes 137 and 138 within the assembly 130 will be completely separated. No flow occurs through the pump-out passage 146 since the annular port 171 in the pump-out valve 148 has been closed by the raising of the valve spool 160. Pressure within the first chamber 137 will raise the piston 134, forcing any water within the second chamber 138 out the standpipe 111 and the hose bibb 113.

As the piston 134 reaches the top of its travel within the assembly 130, the piston valve plunger 145*a* will engage the actuator stop 145*b*, as shown in FIG. 3. Contact between the parts will compress the piston valve spring 186, moving the valve tube 183 downwardly with respect to the piston 134. Movement of the tube 183 unseats the piston valve head 182 from the valve seat 181, permitting water to flow from the first chamber 137 through apertures 235 formed in the tube 183 at the exposed lower end thereof, and into the second chamber 138 and the standpipe 111.

The compression spring 139 exerts a force between the transverse bar 180 and the piston 134 urging the piston downwardly so the piston 134 will assume a position such that a pressure drop is created by water flowing between the valve seat 181 and valve head 182 and through the apertures 235 in the tube 183. Pressure in the first chamber 137 will be higher than that in the second chamber 138 by an amount necessary to offset the force of the spring 139. The piston 134 will maintain the position shown in FIG. 3 for as long as the main valve 127 is open and water continues to flow through the piston valve 144.

As soon as flow ceases, pressures will equalize between the first and second chambers 137 and 138, permitting the bias of the spring 139 to force the piston 134 downwardly. Such movement will close the piston valve 144 and seal the chambers 137 and 138 from one another during continued further downward movement of the piston 134. If the flow has stopped because the valve 216 at the hose bibb 113 is closed, the piston will fall in the assembly 130 only until the piston valve 144 closes, since the water in the chamber 137 has no escape path. Where the flow is stopped because the main valve actuator 126 has been released, the pump-out valve 148 will be opened, permitting water from the first chamber 137 to pass through the pump-out passage 146, through the valve 148, and out the axial flow passage 172 to drain 147.

As the piston 134 reaches the bottom of its travel, the lower seal 135 thereon will be spanned by the pump-out passage port 149, allowing the piston valve head 182 to settle upon the abutment ridge 187 on the first end 132 of the piston assembly 130. Then water which has not been fully pumped out of the drain 147 will be free to flow by gravity backwardly through the system and into the second chamber 138 through the port 149, the annular space 140 about the piston 134, and the restricted flow passage 141 through the piston wall until all the fluid within the system is safely below the frost level 12*a*.

In one exemplary embodiment, the apparatus described above has a piston 134 having a four inch (10.16 cm) diameter and a pump-out travel with the valve 144 closed of four inches (10.16 cm). A $\frac{3}{4}$-inch travel with the valve 144 open has no pump-out effect. The area of the piston is then 12.57 square inches (81 $cm^2$) and the displacement volume is 50.25 cubic inches (823 $cm^3$). Where the standpipe 111 is $\frac{3}{4}$-inch (1.9 cm) pipe and the pump-out tubing 172, 220 and 147 is $\frac{1}{4}$-inch (.64 cm) pipe, the system will accommodate more than 6 feet (1.83 m) of burial depth to the upper part of the piston housing 130.

A spring 139 having a spring constant of 20 pounds per inch may be employed with a 3 inch (7.6 cm) precompression upon assembly. Then where the piston 134 has been raised to the equilibrium position shown in FIG. 3, up to a 155 pound (68.9 newtons) force from the spring 139 will act atop the piston. A pressure drop of 12.33 psi ($8.7 \times 10^3$ kg/$cm^2$) across the valve 144 must occur to keep the piston 134 in an equilibrium position. Where supply line pressure is 50 psi(3.40 atm.) and the appliance is buried 6 feet (1.8m) below grade, some 35 psi (2.38 atm.) pressure is still available to provide flow through the appliance and any attached water outlets provided above grade level. The spring of this arrangement can then reliably perform the pump-out function of moving the piston 134 downwardly in the chamber 131 through a static head of more than 10 feet (3 m) to drain.

SECOND EMBODIMENT

Figure 4:
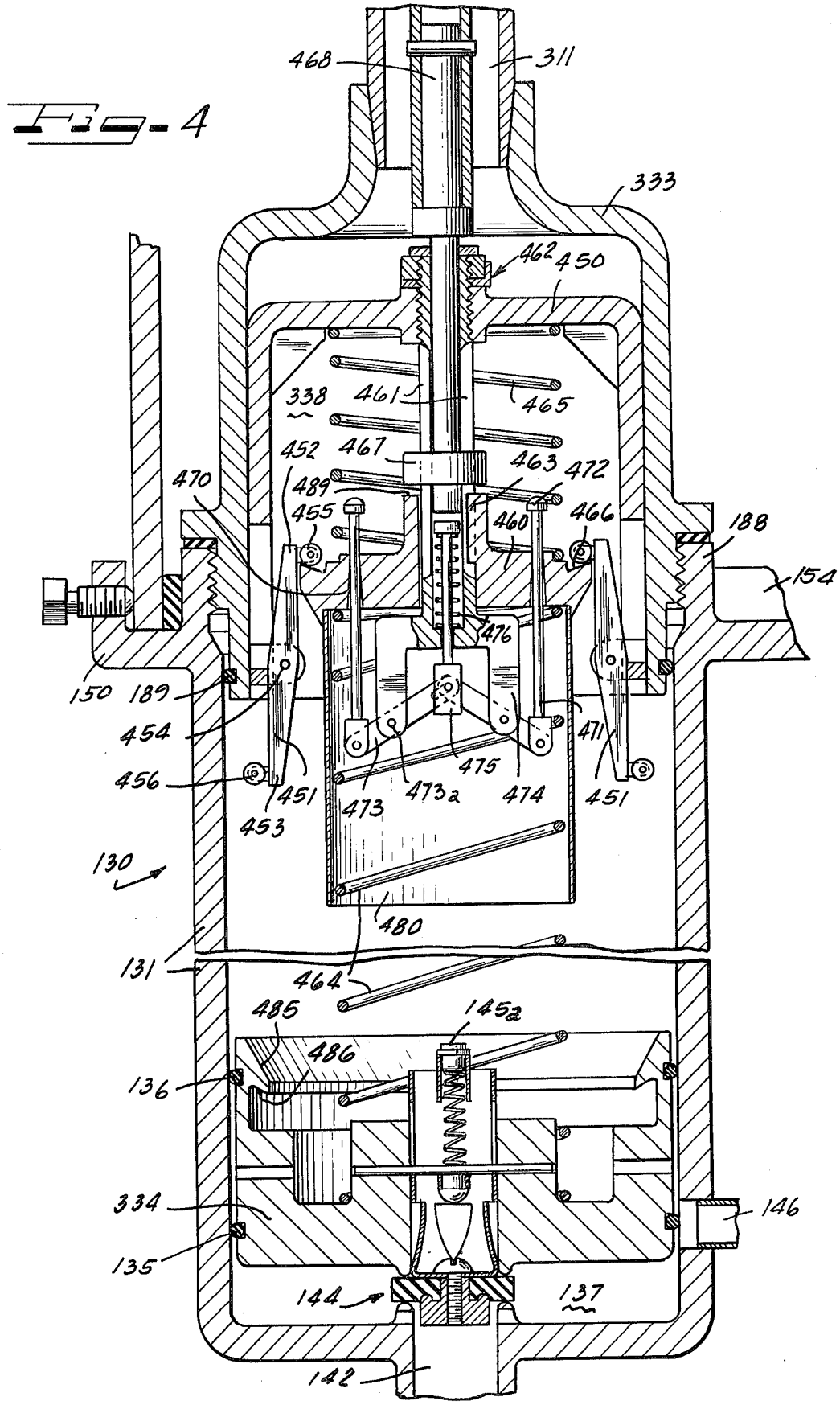
FIG. 4 is a side sectional view of a device incorporating the present invention.
Figure 5:
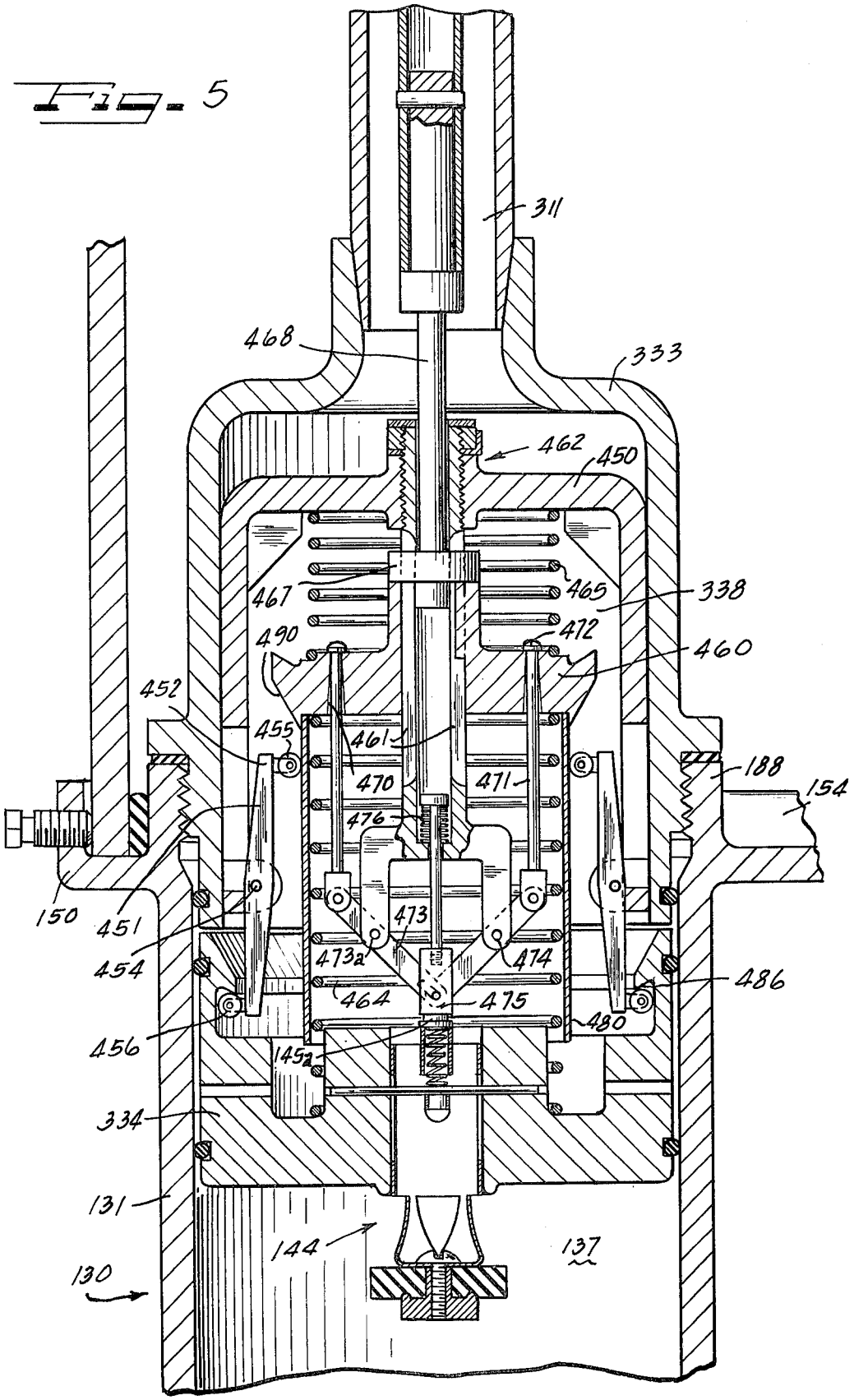
FIG. 5 is a detailed, side sectional view of the upper portion of the chamber of FIG. 4 to an open-flow position.

A second embodiment of the pump-out assembly of the present invention is shown in FIGS. 4 and 5, whereby the pressure drop across the piston 134 may be substantially eliminated. In the second embodiment the piston and the piston valve stop means are somewhat modified, and a piston lock is provided in the pump-out assembly.

In the second embodiment, the main valve housing 155 and the internal components thereof are the same as described in FIG. 2. The basic structure of the pump-out assembly 130 is also the same, as is the flange 150 which connects to the bottom of the burial casing 102.

In this embodiment of the invention, a raised head or second end 333 of the pump-out assembly is threadedly engaged with the raised annular portion 188 of the annular flange 150. Beneath the raised end 333 is a U-shaped header bar 450 which is mounted rigidly within the head 333. At a lower portion of the bar 450, spaced oppositely from one another about the circumference of the head 333 upon the bar 450 are two piston lock bars 451. Each piston lock bar 451 has an upper end 452 and a lower end 453, and is pivoted at its center about a pin 454 fixed to the header bar 450. Spring means are provided between the header bar 450 and piston lock bar 451 to urge the upper ends 452 of the piston lock bars 451 radially inwardly of the second chamber 338. At each end 452 and 453 of each lock bar 451 is a cam roller, the upper cam rollers 455 extending inwardly from the lock bars 451 and the lower cam rollers 456 extending radially outwardly therefrom.

Also provided in the upper part of the piston assembly 130 is floating valve actuator body 460. The valve actuator body 460 slides upwardly and downwardly within the head 333 upon a track member 461 attached to the transverse bar 450 by a threaded connection and lock nut assembly 462. Tabs 463 on the floating valve actuator body 460 engage the tracks 461 for sliding movement therealong.

The vertical position of the floating valve actuator 460 is determined by interaction of a first coil spring 464 acting between a lower surface of the floating actuator body 460 and an upper surface of the piston 334 in the assembly 130, and a second, retarder spring 465 having a lesser spring constant than the spring 464 and situated between the upper surface of the floating valve actuator body 460 and a lower surface of the transverse bar 450. The actuator body 460 is also locked into a downward position by engagement between the upper cam rollers 455 on the piston lock bars 451 which in the down position of the actuator body 460 engage an upper peripheral surface 466 thereof. A reset rod tab 467 is actuatable by a reciprocable reset rod 468 which extends upwardly through the track securement means 462 and the standpipe riser 311 to the lawn hydrant at ground level. Since the spring 464 is stronger than the spring 465, it is only through depression of the reset tab 467 via the rod 468 that the floating valve actuator 460 may be engaged in the position shown in FIG. 4, with the upper surface 466 thereof engaged beneath the cam rollers 455.

The floating valve actuator body 460 is formed with axially-extending slots 470 therethrough on either side of the center thereof. Valve actuator tabs 471 are extended through the slots 470 and have heads 472 at upper ends thereof. The valve actuator tabs 471 are each connected pivotally at their lower ends to actuator linkages 473, each of which in turn pivots about fixed points 473*a* mounted on a U-shaped stop bar 474 carried by the fixed track assembly 461. The links 473 pivotally engage at their opposite ends with a reciprocable valve actuator stop 475.

A compression spring 476 biases the actuator stop 475 toward an upward position along the axis of the assembly from the stop bar 474. The pivot points 473*a* of the links 473 are closer to the pivotal connections to the valve actuating tabs 471 than to the valve actuator stop 475 to obtain a relative increase in movement of the stop 475.

A kick-off sleeve 480 is attached to the lower portion of the floating valve actuator body 460 circumferentially outwardly of the first coil spring 464.

Use of three locking bars 451 and tabs 471 is feasable and improves planar stability of the floating body 460. Then the body 460 and the header bar 450 are made circular in form but have opening therethrough for free passage of water. Either part may be drilled through or formed with spokes and a rim.

The piston 334 is substantially identical to the piston 134 of the embodiment of FIGS. 2–3 except that its upper walls are provided with a cam surface 485 and a lip 486 therebelow. Both the surfaces 485 and 486 are annular, so that the piston 334 may rotate about its axis within the wall 131 without adversely affecting the operation of the system.

In operation, opening of the main valve 127 of the valve portion 100 with pressurized water available from the inlet 110 will admit pressurized water to the first chamber 137, causing the piston 334 to rise in the assembly 130. Such rising will continue until the camming surface 485 of the piston 334 engages the lower cam rollers 456 of the piston lock bars 451. Further lifting of the piston 334 pivots the lock bars 451 about the pivot points 454, moving the upper cam rollers 455 outwardly and disengaging them from the surfaces 466 of the floating valve actuator body 460.

Since the first spring 464 is at this time greatly compressed, the floating valve actuator body 460 will rise against the retarder spring 465 and engage the heads 472 of the valve actuator tabs 471. The floating body 460 will seek an equilibrium position as shown in FIG. 5, causing the valve actuator stop 475 to extend downwardly to a position engageable with the valve actuator plunger 145*a*. As the piston 334 continues to rise, the piston valve 144 will be opened increasingly far until the lower cam rollers 456 engage beneath the annular lip 486 of the piston 334, thereby locking the piston in its raised or fully charged position.

The actuating linkages 473 force the piston valve 144 open to a greater extent than was possible in the embodiment of FIGS. 2 and 3, thereby to reduce the pressure drop of flowing water from the first chamber 137 through the valve 144 and into the second chamber 338.

Release of the piston 334 from the locked position of FIG. 5 does not in this embodiment occur automatically by closing the main valve 127 or shutting off a point of use valve as valve 216 in FIG. 2. Release of the piston 334 from engagement by the lower cam rollers 456 is accomplished only by depressing the reset rod 468 to engage the reset tab 467 upon an upper surface 489 of the valve actuator body 460 and to force same downwardly against the equilibrium attained between the springs 464 and 465 acting thereon.

Downward movement of the body 460 will engage the upper cam rollers 455 by upwardly and outwardly flared camming surfaces 490 on the body 460. These camming surfaces 490 will rock the upper ends 452 of the locking bars 451 to the left, pivoting the bars to release the lip 486 of the piston 334 from engagement with the lower cam rollers 456. The piston 334 will then be free to move downwardly in the piston assembly 130. A slight further depression of the reset tab 467 will reengage the upper cam rollers 455 with upper surfaces 466 of the floating valve actuator body 460. Once the piston valve 144 is closed, the appliance will pump water from the first chamber 137 through the pump-out passage 146 and the pump-out valve 148 to drain 147. Thereafter, operation is similar to that described in conjunction with FIGS. 2 and 3 for the pump-out cycle.

Because the second embodiment of FIGS. 4–5 operates with no substantial pressure drop across the piston valve, this embodiment is ideally suited for use in systems having low water main supply pressures, such as rural mains employing 25 psi (1.7 atm.) pressure and systems employing well pumps.

Although various minor modifications may be suggested by those versed in the art, it should be understood that I wish to embody within the scope of the patent warranted hereon all such modifications as reasonably and properly come within the scope of my contribution to the art.

I claim as my invention:

1. A freeze-proof sanitary valve assembly comprising:
   - a housing forming a combined cylinder and liquid reservoir and adapted to be buried in soil beneath a local frost line;
   - a piston means slidable in said cylinder and normally sealingly dividing said reservoir into variable first and second chambers;
   - bias means urging said piston means to a position minimizing the volume of said first chamber;
   - a pressurized water supply line selectively communicating to said first chamber;
   - an exposed water outlet device through which water passes to atmosphere and communicating to said second chamber;
   - valve means responsive to movement of the piston means for selectively communicating said supply line to said outlet device when said piston means has moved to minimize said volume of said second chamber;
   - said bias means being overcome by water pressure from said supply line exerted upon said piston means in opposition to the force of said bias means and permitting said movement of said piston means; and
   - a pump-out passage selectively communicating said first chamber to atmosphere, whereby upon inflow of water from said supply line said piston is moved through the cylinder and reservoir against said bias means to a fully charged position, whereupon said valve means opens to permit flow of said water to said outlet device, and whereby upon termination of said flow and movement of said piston away from said fully charged position under the urging of said bias means said valve means closes, water in said first chamber is pumped therefrom through said pump-out passage by said piston in a pump-out stroke, and said stroke simultaneously draws water from said water outlet device into said second chamber.

2. A freeze-proof sanitary valve assembly as defined in claim 1 wherein said assembly further comprises a main valve housing forming a main flow valve portion and a pump-out valve portion, said main flow valve portion comprising:
   - a valve spool carrying a valve head,
   - a valve seat axially aligned with said valve head and engageable therewith, and
   - a flow passage downstream of said valve seat communicating to said first chamber; and said pump-out valve portion comprising:

a pump-out valve port in said main valve housing communicating to said first chamber via a first portion of said pump-out passage, an annular port in said valve spool spaced axially from said valve head and selectively registerable with said valve port for fluid communication therebetween when said main valve head is fully engaged with said valve seat and to block communication therebetween when said main valve is open, and said annular port communicating to atmosphere through a second portion of said pump-out passage.

3. A freeze-proof sanitary valve assembly as defined in claim 2, wherein said assembly further comprises a main valve actuator tube passing from above said soil and connected to said valve spool in said valve housing, and wherein a part of said second portion of said pump-out passage passes axially through said main valve actuator tube.

4. A freeze-proof sanitary valve assembly as defined in claim 3, said actuator tube being reciprocable vertically with respect to said housing, thereby to open and close said main and pump-out valves.

5. A freeze-proof sanitary valve assembly as defined in claim 1, further comprising:

a ring seal attached to said piston means at a periphery thereof to effect said normal sealing division of said reservoir at said piston into said first and second chambers; and a port in a wall of said housing communicating said pump-out passage to said first chamber, the port having an extent sufficient to span said ring seal when said piston means is in a position minimizing the volume of the first chamber, whereby said first and second chambers are communicated together past said ring seal when said bias means are fully extended, and whereby said pump-out passage drains back into said second chamber upon ceasing of movement of said piston after said pump-out stroke.

6. A freeze-proof sanitary valve assembly as defined in claim 5, wherein said port, said seal, said piston means, and said housing form a restricted flow passage thereamong between said first and second chambers.

7. A freeze-proof sanitary valve assembly as defined in claim 6, further comprising:

a second ring seal axially spaced from said first-mentioned ring seal, the two ring seals forming an annular chamber between said first seal and said second seal; and means in said piston forming an aperture extending from said annular chamber to said second chamber.

8. A freeze-proof sanitary valve assembly as defined in claim 1 wherein said valve means is formed in said piston means and comprises:

a flow passage through said piston means between said first and second chambers;

a piston valve in said piston biased to normally close said flow passage; and piston valve actuating means for opening said piston valve when said piston means has moved to its said fully charged position.

9. A freeze-proof sanitary valve assembly as defined in claim 8, wherein said valve means further comprises:

a valve seat and a valve head constituting said piston valve, the valve head being spring-biased against said valve seat; and said piston valve actuating means comprising a valve plunger carried by said valve head and a valve plunger stop engageable with said plunger at said charged position of said piston travel.

10. A freeze-proof sanitary valve assembly as defined in claim 1, further comprising capture means mounted in said housing in said second chamber and adapted to maintain said piston means at its fully charged position for continued fluid flow without substantial pressure loss therein, said capture means releasably engaging said piston upon opening of said piston valve means for fluid flow therethrough.

11. A freeze-proof sanitary valve assembly as defined in claim 10, wherein said capture means comprise:

a floating valve actuator body reciprocally mounted upon a track in said second chamber;

at least two locking bars mounted circumferentially symmetrically in said housing for rocking movement with respect thereto and carrying a cam roller on each end thereof;

said floating valve actuator body having a radially extending lip thereabout for engaging beneath an upper one of said cam rollers on each of the locking bars;

said piston having an annular lip extending radially of the piston on a side thereof bounding said second chamber, said lip having an upwardly outwardly flared upper camming surface thereabove engageable with said cam rollers on a lower end of each of said locking bars;

a second biasing means engaged between said housing and said floating valve actuator body for urging said body toward said piston means and opposing action of said first-mentioned biasing means, which acts upon a lower surface of the floating valve actuator body;

said track carrying a valve actuator stop; and said floating valve actuator body further carrying means cooperating with said stop for fully opening said valve means by engagement of said stop with said valve means upon rise of the piston means to said fully charged position.

12. A freeze-proof sanitary valve assembly as defined in claim 11 further comprising:

a reset tab mounted reciprocally with respect to said housing along said track and engageable with a surface of said floating valve actuator body; and an upwardly outwardly flared lower camming surface upon said floating valve actuator body;

whereby pressing of said reset tab moves said actuator body toward said piston means, rocking said locking bars outwardly by engagement of said camming surface of said actuator body with said upper cam rollers thereof, releasing said piston lip from said lower cam rollers on said locking bars, and engaging said actuator body beneath said upper cam rollers, whereby said piston means is free to move under the bias of said first spring.

13. A freeze-proof sanitary valve assembly as defined in claim 12 further comprising a reciprocable reset rod extending through the standpipe and carrying said reset tab in a lower end thereof.

14. A freeze-proof sanitary valve assembly as defined in claim 11 wherein said means on said floating valve actuator body for fully opening said valve means comprises:

a valve actuating tab having a shaft portion slidably received in said floating valve actuator body, an expanded head on an upper end thereof engageable with the upper surface of said actuator body, and a lower end;

an actuator linkage having two ends and pivotally mounted to said track at a pivot point;

a first end of said linkage being pivotally mounted to said lower end of said actuator tab, a second end of said linkage being pivotally and slidably mounted to said valve actuator stop, and said pivot point being closer to said first end than to said second end of said linkage, thereby to open said valve means widely upon engagement of said piston means with said capture means to avoid large pressure losses across said valve means.

15. A freeze-proof sanitary valve assembly as defined in claim 1 wherein said assembly further comprises a hollow burial casing sealingly joining to an upper portion of said housing and extending from said housing to a ground level thereabove, said casing enclosing access ports to said housing.

16. A freeze-proof sanitary valve assembly as defined in claim 15 wherein said casing is filled with an insulating material to prevent penetration of freezing temperatures to said housing.

17. A water supply appliance as defined in claim 1 further comprising:

first and second sealing means formed between said piston and said reservoir wall and spaced apart axially of said piston;

a restricted flow passage communicating between said second volume of said chamber and a space formed between said first and second sealing means, said piston, and said chamber walls; and a port spanning said first sealing means and communicating said first and second chamber volumes together via said piston flow passage as said piston reaches a rest position adjacent said first end of said chamber, whereby fluid remaining in said pump-out passage after said piston comes to rest may flow backwardly into said second volume below said freeze depth.

18. A sanitary freeze-proof water supply appliance comprising:

a fluid outlet to atmosphere;

a main valve between said inlet and said outlet to control flow of fluid through said appliance to said fluid outlet;

an elongate fluid reservoir having a peripheral wall and having a first end of said reservoir communicating to said fluid inlet downstream from said main valve and a second end of said reservoir communicating to said fluid outlet;

a housing containing said main valve and said reservoir and adapted to be buried in soil beneath a local freeze-depth of said soil;

a piston slidably received in said reservoir and dividing said reservoir into variable first and second chambers;

biasing means biasing said piston toward said first end of said reservoir;

a piston valve selectively openable to communicate said first and said second chambers;

a piston valve actuator stop near said second end of said reservoir and adapted to open said piston valve upon engagement therewith when said piston is near said second end of said reservoir;

a pump-out passage communicating said first chamber volume at a port near said first end thereof to a drain; and a pump-out valve in said passage between said first chamber and said drain and cooperating with said main valve to be open when said main valve is fully closed and closed when said main valve is open, whereby after flow of pressurized fluid through said housing, closing of said main valve permits said piston to be moved by said bias means to reduce said first chamber and to pump fluid within said first chamber to said drain, and to draw water from said pump-out passage into said second chamber and beneath said local freeze line.

* * * * *